United States Patent [19]

Nye

[11] Patent Number: 4,846,469

[45] Date of Patent: Jul. 11, 1989

[54] APPARATUS FOR FLEXIBLY MOUNTING A BASKETBALL GOAL

[75] Inventor: Stephen F. Nye, Roy, Utah

[73] Assignee: Lifetime Products, Inc., Clearfield, Utah

[21] Appl. No.: 108,919

[22] Filed: Oct. 15, 1987

[51] Int. Cl.[4] ..... A63B 63/08

[52] U.S. Cl. ..... 273/1.5 R

[58] Field of Search ..... 273/1.5 R; 172/264, 172/265; 267/170, 179, 169, 291

[56] References Cited

U.S. PATENT DOCUMENTS

| | | | |
|---|---|---|---|
| 1,811,987 | 6/1931 | Wales | 267/291 X |
| 2,935,144 | 5/1960 | Graham | 172/265 |
| 3,462,143 | 8/1969 | Bidelman | 273/1.5 R |
| 4,111,420 | 9/1978 | Tyner | 273/1.5 R |
| 4,151,989 | 5/1979 | Dittrich | 273/1.5 A |
| 4,194,734 | 3/1980 | Tyner | 273/1.5 R |
| 4,320,896 | 3/1982 | Engle et al. | 273/1.5 R |
| 4,348,022 | 9/1982 | O'Donnell | 273/1.5 R |
| 4,365,802 | 12/1982 | Ehrat | 273/1.5 R |
| 4,377,283 | 3/1983 | Mahoney | 273/1.5 R |
| 4,433,839 | 2/1984 | Simonseth | 273/1.5 R |
| 4,438,923 | 3/1984 | Engle et al. | 273/1.5 R |
| 4,441,709 | 4/1984 | Schroeder et al. | 273/1.5 R |
| 4,465,277 | 8/1984 | Dittrich | 273/1.5 A |
| 4,483,534 | 11/1984 | O'Donnell | 273/1.5 R |
| 4,534,556 | 8/1985 | Estlund et al. | 273/1.5 R |
| 4,575,079 | 3/1986 | De Faveri | 273/1.5 R |
| 4,583,732 | 4/1986 | Allen | 273/1.5 R |

OTHER PUBLICATIONS

Slam Dunk Rim, Inc., Sales Circular rec'd 4/11/1978.

*Primary Examiner*—Paul E. Shapiro

*Attorney, Agent, or Firm*—Workman, Nydegger & Jensen

[57] ABSTRACT

An apparatus for mounting a basketball goal to a backboard or other rigid support such that when a force exceeding a threshold force is applied to the goal, the mounting apparatus of the present invention permits the goal to flexibly deflect away from the backboard along an arc-shaped path while the mounting apparatus dissipates much of the energy transferred to the goal from the impact of the force. The apparatus of the present invention includes a spring and a resilient ring which are used in combination to retrofit a goal to a backboard such that damage to the goal or backboard when someone dunks the basketball and/or suspends from the rim may be avoided. When a threshold force is applied to the goal the spring held in place by a bolt and securing the upper portion of the mounting plate of the goal to the backboard is compressed thereby allowing the upper portion of the mounting plate to temporarily separate from the backboard. Simultaneously, a resilient ring held in place by a bolt and securing the lower portion of the mounting plate to the backboard is also compressed thereby allowing the mounting plate to pivot. When the force is released, the goal resumes its horizontal position where it remains secured to the backboard during conditions of regular use.

26 Claims, 4 Drawing Sheets

APPARATUS FOR FLEXIBLY MOUNTING A BASKETBALL GOAL

BACKGROUND

1. The Field of the Invention

The present invention relates to an apparatus for flexibly mounting a basketball goal to a basketball backboard such that when a threshold force is applied to the basketball goal, the mounting apparatus will absorb much of the energy applied to the goal by the impact of that force by allowing the goal to break away retractably from the backboard.

2. The Background of the Invention

In recent years it has become increasingly popular to "dunk" the basketball. This involves throwing the basketball through the basketball goal from a position above the rim of the goal. While it is possible to dunk the basketball without the basketball or the player touching the rim during the process, it is not uncommon for a player to strike the rim with the basketball or with his arms or to suspend himself from the rim of the goal after releasing the basketball thereby imparting substantial dynamic forces to the goal.

If the force applied to the basketball rim is of sufficient magnitude, many problems could result. For example, at one time it was popular to construct basketball backboards from glass. Thus, it was not uncommon for a player to shatter the glass backboard as a result of the force applied to the goal while dunking the basketball. This was extremely disadvantageous in that it resulted in a possibility of injury to players surrounding the goal as well as to spectators in the immediate area. This was additionally disadvantageous in that the backboard had to be replaced before the game could be continued. Replacing a glass backboard requires a substantial amount of time. Therefore, when a glass backboard was broken, it resulted in an unacceptable delay of the basketball game. It can also be prohibitively expensive to replace glass backboards each time they are damaged. Although most glass backboards have been replaced today with backboards made of materials which are resistant to shattering, it is still desirable to eliminate the possibility of damage to the backboard which may result from the force applied to the basketball goal when a player dunks the basketball.

Not only is it possible to break or deform a backboard by dunking the basketball, but it is also possible to bend or otherwise destroy the basketball goal itself by applying a substantial force to the goal. Although the goals used for professional or organized basketball games are constructed to be very durable, many goals sold for backyard or playground use are not of such durable construction. Once a goal has been permanently deformed due to the impact of forces applied to it by repeated dunking of the basketball, it is very difficult, if not impossible, to restore the goal to its original, horizontal position. Thus, the goal usually must be replaced thereby resulting in an undesirable expense to the owner.

Several attempts have been made to eliminate the problems mentioned above. What appears to be the universally accepted solution to the problem is to employ an apparatus which will allow the basketball goal to "break away" from its original horizontal position when a threshold force is applied to the goal. The apparatus allows the goal to break away retractably from the backboard while absorbing a substantial amount of the energy imparted to the goal from the impact of the force. An apparatus such as this allows the goal to maintain its horizontal position during regular play when only minimal forces are applied to it, such as the force of the basketball bouncing off of the goal. However, when a substantial force is applied to the goal, such as one resulting from someone dunking the basketball, the mounting apparatus will allow the goal to be broken away from the backboard thereby absorbing much of the energy imparted to the goal by the impact of that force.

Although many attempts have been made to successfully provide a break-away goal which solves the problems mentioned above, these attempts do not provide the most efficient solution to the problem. For example, one of the major disadvantages of the prior art apparatus is that they cannot be used on an existing basketball goal and backboard. Many of the prior art devices are constructed such that they are an integral part of the basketball goal. Thus, in order to use these prior art devices, it is necessary to purchase an entirely new basketball goal thereby rendering useless the existing goal. Accordingly, these prior art devices can only be obtained at a substantial expense to the purchaser.

A further disadvantage of many of the prior art breakaway goals is that they tend to be of a very complex nature. As with most mechanical apparatus, complexity results in several disadvantages. First, the breakaway apparatus of the prior art goals are expensive to manufacture, resulting in an increased price to the consumer. Apparatus of a complex nature also utilize more parts which leads to a greater frequency of failure of the apparatus. Apparatus of a complex nature may also be difficult to install, as well as difficult to repair when a failure does occur. Additionally, many of the apparatus of the prior art are constructed of materials which are not designed for outdoor use.

It will be appreciated, therefore, that what is needed in the art is an apparatus for enabling a standard basketball goal to be converted into a break-away goal capable of breaking away from the backboard when a threshold force is applied to it, wherein such conversion is accomplished through retrofitting the apparatus to the basketball goal and backboard.

It would be an advancement in the art to provide an apparatus as described above which is constructed of materials which are of a durable nature to withstand the harsh weather conditions which can result from continued outdoor use of a basketball goal.

It would also be an advancement in the art to provide an apparatus as described above which could be economically produced and easily assembled.

BRIEF SUMMARY AND OBJECTS OF THE INVENTION

The present invention includes a novel apparatus for flexibly mounting a basketball goal to a basketball backboard so that the goal may break away from the backboard when a threshold force is applied to the goal. More particularly, the apparatus of the present invention dissipates much of the energy applied to the goal by the impact of the threshold force thereby protecting the goal and the backboard from being damaged.

The apparatus of the present invention has two types of mounting means, a biased mounting means and a flexible mounting means. These mounting means are employed to hold the basketball goal horizontal and a mounting plate of the goal in a position biased against the backboard or other rigid support member. One or more biased mounting means are used to mount the upper portion of the mounting plate of the basketball goal to the backboard, while one or more flexible mounting means are used to mount the lower portion of the mounting plate of the goal to the backboard. Each biased mounting means has a spring secured about a bolt so that the mounting plate of the basketball goal is biased towards the backboard. Thus, when a threshold force is applied to the basketball goal and against the biasing, the spring is compressed and the mounting plate breaks away from its resting position biased toward the backboard and moves away from the backboard along an arcuate path.

Each flexible mounting means has a resilient ring that absorbs force when the basketball goal is broken away from the backboard. The ring permits the goal to rotate about a movable point near the lower portion of the mounting plate as the goal breaks away from the backboard. Thus, upon application of the threshold force to the basketball goal, the upper portion of the mounting plate compresses the springs on the biased mounting means and allows the upper portion of the mounting plate to separate from the backboard. The lower portion of the mounting plate acts on the resilient ring of the flexible mounting means which provides sufficient flexibility at the lower portion of the mounting plate so that the goal may pivot about a movable point near the lower portion of the mounting plate.

When a threshold force is applied to the basketball goal, the compression of the spring of the biased mounting means and the compression of the ring of the flexible mounting means serve to dissipate a substantial amount of the energy transmitted through the basketball goal from the impact of the threshold force. The energy is absorbed by the spring and ring rather than by the basketball goal and backboard. Hence, the likelihood of damaging the basketball goal or the backboard by applying a substantial force to the basketball goal is significantly reduced.

Accordingly, it is an object of the present invention to provide an apparatus for protecting the basketball goal and backboard from being damaged when a substantial force is applied to the basketball goal thereby reducing the possibility of injuries to players and spectators resulting from shattered glass backboards, eliminating the delay resulting from having to replace a basketball goal or backboard which is damaged, and eliminating the expense of making these repairs.

It is a further object of the present invention to provide an apparatus which allows the basketball goal to break away from the backboard thereby reducing the possibility of injury to players which may result from dunking a basketball through a rigid goal.

It is also an object of the present invention to provide an apparatus which secures the goal in its desired horizontal disposition until a threshold force is applied to the goal which causes the mounting plate to break away from the backboard.

Still another object of the present invention is to enable conversion of a standard basketball goal and backboard into a break-away goal capable of breaking away from the backboard when a threshold force is applied to the goal and returning to its normal horizontal disposition when the force is released.

It is an additional object of the present invention to provide a mounting apparatus as described above which is simple to install and can be economically manufactured.

These and other objects of the invention will become apparent upon reading the following detailed description and appended claims, and upon reference to the accompanying drawings.

DETAILED DESCRIPTION OF THE PREFERRED EMBODIMENTS

Figure 1:
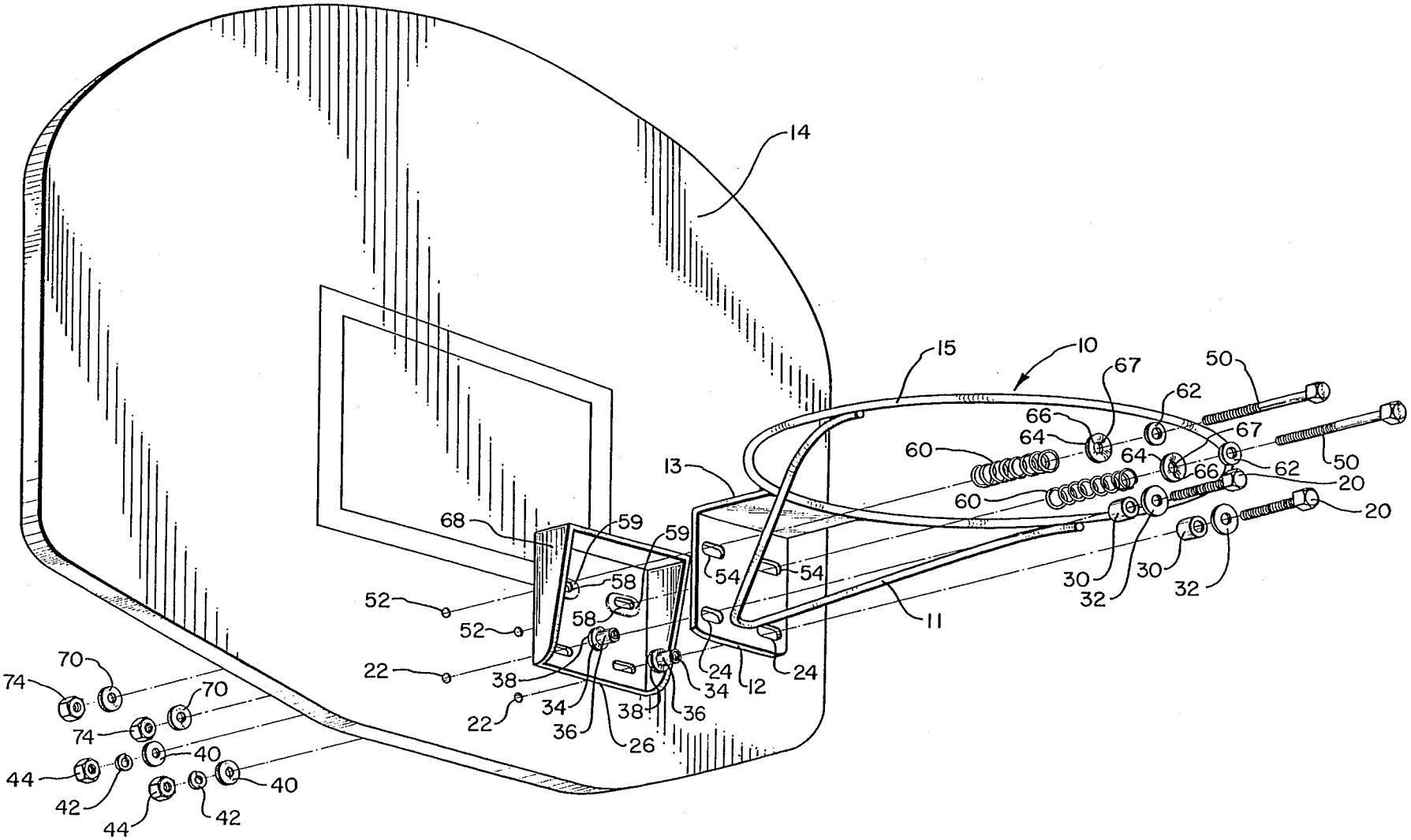
FIG. 1 is an exploded perspective view of the present invention showing the disposition of various components in mounting a standard basketball goal to a conventional backboard.

The present invention is directed to an apparatus for flexibly mounting a basketball goal to a backboard such that when a threshold force is applied to the goal, such as might be applied to the goal when someone dunks the basketball and/or suspends from the rim, the goal retractably breaks away from the backboard. In this manner, much of the energy from the impact of the force applied to the goal is dissipated without damage to the goal or backboard.

The forces which are most destructive to a goal are usually applied to the goal primarily in a downward direction. It is not uncommon to see a goal mounted to a backboard which is bent to a position below the horizontal. With the present invention, however, the goal does not bend or permanently deform, but the mounting apparatus allows the entire goal to rotate into the broken-away position while dissipating much of the energy transferred to the goal by the impact of the force applied to the goal. When this force is no longer applied to the goal, the goal returns to the horizontal position where it remains rigidly mounted to the backboard during regular use until another threshold force is applied to the goal causing it again to break away from the backboard. Thus, it can be seen that the mounting apparatus of the present invention protects the goal and the backboard from damage which may result from the impact of large forces being applied to the goal.

As used herein, a "threshold force" is any force which, when applied to the basketball goal, results in breaking away of the goal from the backboard to be imminent. As will be further explained below, the present invention may be adjusted such that the threshold force may be increased or decreased as desired; that is, the mounting apparatus may be adjusted such that a greater or lesser force is required to be applied to the goal before the goal will break away from the backboard.

In the preferred embodiment of the invention, the apparatus should be adjusted such that the goal will not break away during regular use, that is, when the only forces acting upon the goal are those resulting from the basketball striking the goal when those using the goal try to shoot a basket. However, when those using the goal dunk the basketball or hang from the net or rim of the goal, the forces applied to the goal are often substantially greater than those applied to the goal when someone hits the goal with the basketball while shooting baskets. Use of the goal wherein forces are imparted to the goal which are greater than those resulting from shooting baskets, especially forces of sufficient magnitude as to damage the goal or backboard or injure a player attempting to dunk the basketball, is beyond the scope of "regular use" as that term is used herein.

The threshold force is greater than any force applied to the goal during regular use because under conditions of regular use, the goal should react as though it is rigidly mounted to the backboard. If the goal were allowed to break away during regular use, the basketball would react differently when it strikes the goal than it would when striking a goal that is rigidly mounted to a backboard.

The threshold force should not be so high that a force applied to the goal would bend or otherwise damage the goal or backboard before the threshold force is reached. Thus, the threshold force should be set so that the goal will always break away from the backboard when a force sufficient to damage the goal or backboard is applied to the goal, and so that the goal will not break away from the backboard during regular use. There may be a wide range of forces which fall between the two extremes outlined above. The determination of where the threshold force is set within that range is a matter of preference to those using the goal.

Reference is now made to the figures wherein like parts are referenced by like numerals throughout. With particular reference to FIG. 1, the present invention is used to mount a goal 10 having a mounting plate 12 to a backboard 14 or other rigid support member. The goal 10 comprises a rim brace 11, the mounting plate 12, a horizontal plate 13, and a circular rim 15. The mounting plate 12 of the goal 10 is perpendicular to the plane in which the rim 15 and the horizontal plate 13 lie, and the mounting plate 12 extends downwardly from that plane. The mounting plate 12 has an upper portion and a lower portion. The rigid support member can be a standard basketball backboard 14, as illustrated in FIGS. 1 and 2, or may comprise some other rigid support to which the backboard 14 and the conventional goal 10 are mounted.

Figure 2:
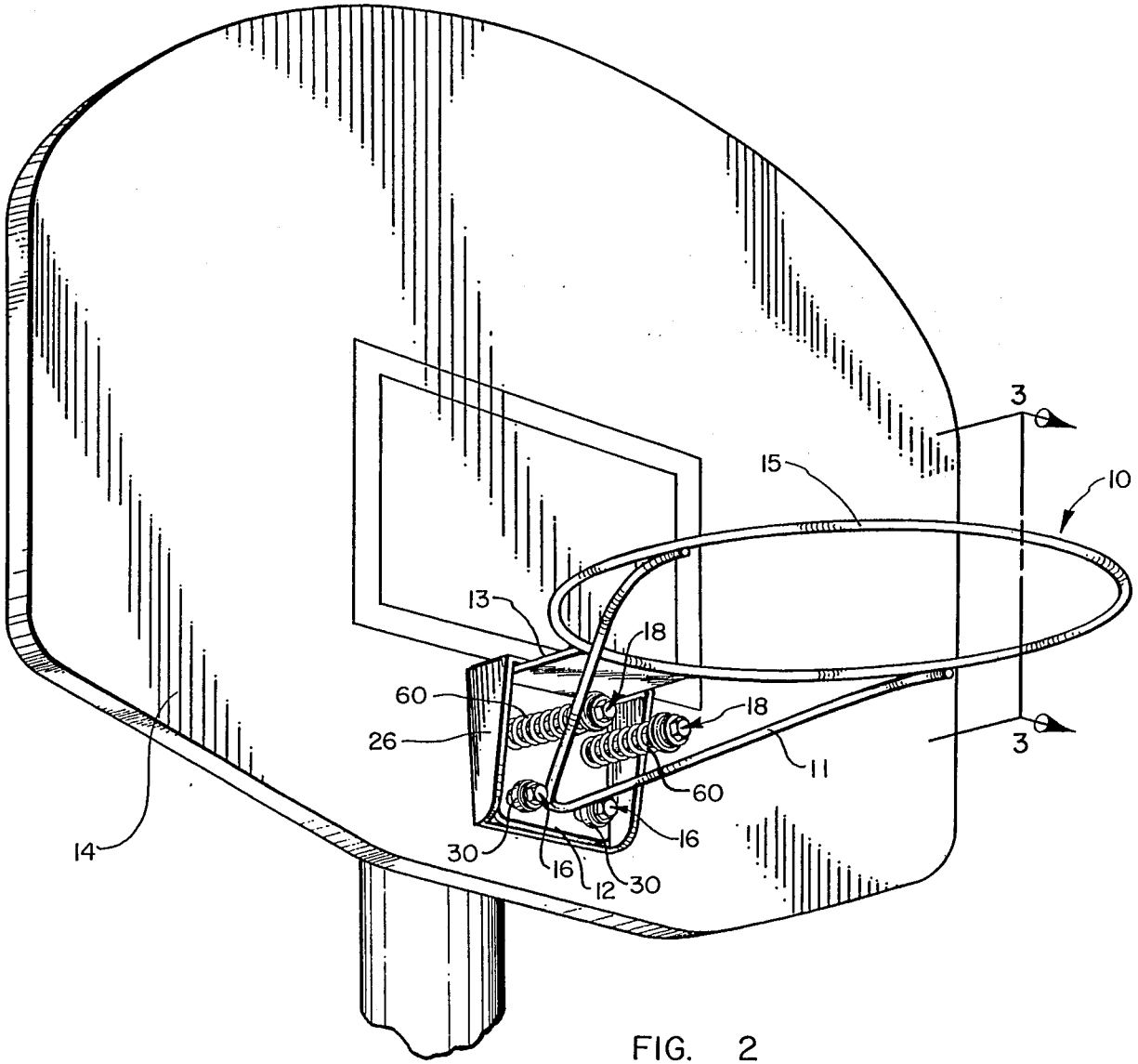
FIG. 2 is a perspective view of the present invention as it is used to mount a standard basketball goal to a conventional backboard.

As can best be observed in FIG. 2, the apparatus of the present invention comprises at least two mounting means, a flexible mounting means 16 and a biased mounting means 18. Because the present invention is designed for use in retrofitting a goal to a backboard thereby converting the rigidly mounted goal into a break-away goal, the number of flexible mounting means and biased mounting means employed is governed by the bolt pattern on the goal and backboard. For example, the bolt pattern shown on the backboard 14 in FIG. 1 is typical in that it has four holes spaced in a rectangular configuration. Thus, for this particular bolt pattern, two flexible mounting means 16 and two biased mounting means 18 may be used, as can be best seen by reference to FIG. 2.

When the goal 10 breaks away from the backboard 14, as will be more fully described later, the goal 10 deflects in a substantially arcuate path about a movable axis near the lower portion of the mounting plate 12. It is the combination of the biased mounting means 18 used to mount the upper portion of the mounting plate 12 to the backboard 14 with the flexible mounting means 16 used to mount the lower portion of the mounting plate 12 to the backboard 14 which allows the goal 10 to break away from the backboard 14. Thus, a flexible mounting means 16 would be used in each hole in the lower portion of the mounting plate 12 and a biased mounting means 18 would be used in each hole in the upper portion of the mounting plate 12.

It will be appreciated that among the many commercially available goals, there are many variations in basic structure. For example, while most goals have a rim brace 11 which is welded or otherwise attached to the mounting plate 12 of the goal at a point along the line intersecting the mounting holes in the lower portion of the mounting plate 12, some do not. Some goals are configured such that the rim braces 11 are welded to the mounting plate 12 of the goal 10 at a point slightly above or below the line intersecting the lower mounting holes in the mounting plate 12. While the advantages of the present invention are best realized when used with a goal having the rim brace 11 attached to the mounting plate 12 along the line intersecting the lower mounting holes in the mounting plate 12, the present invention will also function if the rim braces 11 is affixed to the mounting plate 12 slightly above or slightly below the line intersecting the lower mounting holes in the mounting plate 12.

Although, as mentioned above, most bolt patterns consist of four holes in a rectangular configuration, some bolt patterns may differ in the number of holes they provide or in the configuration of the holes. The present invention may be used to retrofit any goal 10 to any backboard 14 so long as the bolt pattern provides at least one hole in the upper portion of the mounting plate 12 for use with a biased mounting means and at least one hole in the lower portion of the mounting plate 12 for use with a flexible mounting means. It is also necessary that the goal 10 be configured such that any rim brace 11 does not extend over any of the holes in the bolt pattern thereby preventing the flexible mounting means 16 or the biased mounting means 18 from extending outwardly from the hole.

Each flexible mounting means 16 comprises a threaded bolt 20 (see FIG. 1) which fits through a lower mounting hole 24 in the lower portion of the mounting plate 12 and through a lower mounting hole 22 in the rigid support member 14. The orientation of the bolt 20 is not critical to the correct operation of the break-away mounting apparatus, but it is preferred that the head of bolt 20 be on the side of the mounting plate 12, as shown in FIG. 1, to facilitate assembly of the device.

A resilient ring 30 is provided between the head of the bolt 20 and the mounting plate 12. An inside washer 32 fits between the head of the bolt 20 and the ring 30 to provide a greater surface area at the head of the bolt 20 upon which the ring 30 may act. The ring 30 may be a rubber ring such as is known to those skilled in the mechanical arts or, alternatively, it may be constructed of any other resilient material so long as it has the requisite elastic properties to accomplish the purposes of the flexible mounting means as hereinafter described.

A shroud 26 is provided having holes 28 in its lower portion and holes 58 in its upper portion. The holes in the shroud 26 are elongated so that the shroud 26 may be used with several variations of four-hole, rectangularly shaped bolt patterns. The shroud 26 is preferably constructed of a polymeric material which provides for inexpensive mass production, but it will be appreciated that the shroud 26 may be made from several different types of materials so long as they are sufficiently resistant to the demands of harsh weather conditions. The shroud 26 is mounted between the mounting plate 12 of the goal 10 and the backboard 14. The holes 28 in the lower portion of the shroud 26 correspond with the holes 24 in the mounting plate 12 and the holes 22 in the backboard 14. Thus, the shroud 26 is mounted between the mounting plate 12 and the backboard 14 by extending the bolt 20 through the hole 24 in the mounting plate 12, the hole 28 in the shroud 26 and the hole 22 in the rigid support member 14.

A T-nut 34 having a sleeve 36 and a flange 38 is threaded onto bolt 20 and is positioned on the bolt 20 between the mounting plate 12 and the shroud 26. The sleeve 36 of T-nut 34 extends through the hole 24 in the mounting plate 12 and inside the ring 30. Thus, when fully assembled, the ring 30 fits over the sleeve 36 of T-nut 34, and the flange 38 of T-nut 34 operates to hold the shroud 26 firmly against the backboard 14.

An outside washer 40 and a lock washer 42 fit over the end of bolt 20 and are held firmly against the backboard 14 by a nut 44 which is threaded on the end of bolt 20 and tightened. As the nut 44 is tightened, the mounting plate 12, the flange 38 of T-nut 34, the shroud 26, and the backboard 14 are tightened together so that the goal 10 is rigidly mounted at its lower portion to the backboard 14.

The nut 44 must be tightened to provide a substantial amount of compression on the ring 30 so that the goal 10 is mounted with sufficient force against the backboard 14 that when the goal 10 is hit by a basketball during normal use, it remains rigid. However, the amount of compression on ring 30 should not be so great that the mounting plate 12 will not be able to pivot about a movable point near the lower portion of mounting plate 12 when the goal is broken away from the backboard 14 as will be explained below.

The mounting apparatus of the present invention is also provided with at least one upper bolt 50 used to mount the upper portion of the mounting plate 12 to the backboard 14. Upper bolt 50 fits through an upper mounting hole 52 on the backboard 14, an upper hole 54 on the mounting plate 12, and through a hole 58 in the upper portion of the shroud 26. As previously stated, the holes 58 in the shroud 26 are elongated such that the shroud 26 may fit the various bolt patterns of the mounting plate 12 and rigid support member 14 used by different manufacturers of basketball goals and backboards.

A bias means is provided on the upper bolt 50 such that, when assembled, the upper portion of the mounting plate 12 is biased against the shroud 26 and the backboard 14. While the bias means may comprise any one of a number of mechanical apparatus such that the requisite biasing is performed, it is presently preferred that the bias means comprise a helical spring 60 as illustrated in FIG. 1. The spring 60 surrounds the shaft of the upper bolt 50 and is held in position by an inside washer 62 and a conical washer 64. The conical washer 64 is provided with a flanged portion 66 against which the spring 60 may rest. The spring 60, in the presently preferred embodiment of the invention, is manufactured such that it is substantially flat at each end. Therefore, it may rest against the flanged portion 66 of the conical washer 64. As can best be seen by reference to FIG. 3, the conical washer 64 is also configured with a sleeve 67 having a conical shape such that the sleeve 67 lies within the end of the spring 60. Therefore, the spring 60 is held in a position concentric with the upper bolt 50 by the conical washer 64. The inside washer 62 fits between the conical washer 64 and the head of the bolt 50 to equalize the forces along the flanged portion 66 of the conical washer 64.

Figure 4:
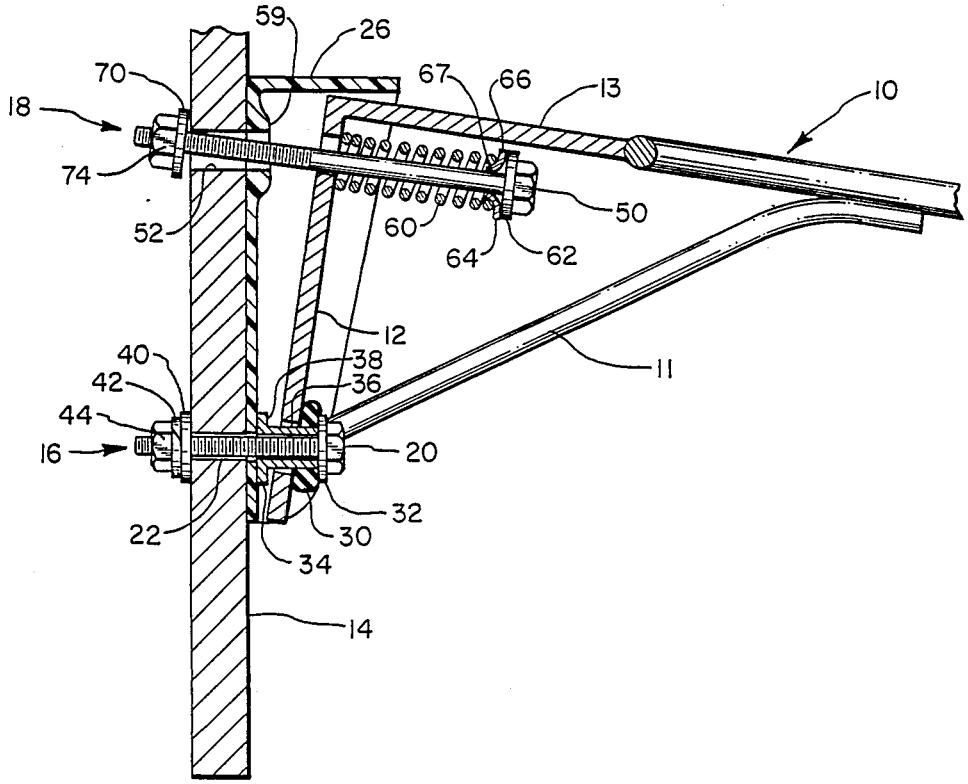
FIG. 4 is a cross-sectional view similar to that illustrated in FIG. 3 but showing the present invention in the slightly broken-away position.

The shroud 26 is further configured such that spacers 59 are located around the upper holes 58 of the shroud 26 as can be seen by reference to FIG. 4. The width of the spacer 59 should be approximately the same width as the width of the flange 38 on the T-nut 34 used to mount the lower portion of mounting plate 12 to backboard 14. The spacer 59 is provided so that the mounting plate 12 is mounted equidistant from the backboard 14. This ensures that the mounting plate 12 will be mounted in a substantially vertical position thereby ensuring that the goal 10 will be mounted in a substantially horizontal position as is desirable when mounting a basketball goal.

An outside washer 70 is provided on the upper bolt 50 and is tightened against the backboard 14 by a nut 74. By tightening the nut 74 on the bolt 50, the upper portion of the mounting plate 12, the shroud 26, and the backboard 14 are firmly mounted together. It will be appreciated that the further the nut 74 is tightened on the bolt 50, the greater amount the spring 60 will be compressed. It is the force which the spring 60 exerts on the mounting plate 12 which determines how firmly the goal 10 will be mounted to the backboard 14 at the upper portion of the mounting plate 12.

With the goal 10 mounted to the backboard 14 as described above, the threshold force may be adjusted as desired. In operation, it is desirable that the goal 10 remain rigidly disposed in a substantially horizontal position during regular use. Because during regular use the goal 10 is subject to several different forces, such as those caused by the basketball striking the goal or by players inadvertently hitting the goal, the goal 10 must be secured with sufficient force against the backboard 14 to not break away during regular use. This is accomplished by tightening the nut 74 to slightly compress the spring 60. Because the force which the spring 60 exerts against the mounting plate 12 when compressed is directly proportional to the distance the spring is compressed, the nut 74 may be tightened on the upper bolt 50 until the goal 10 stays mounted in a rigid position during normal play.

As was mentioned above, when assembling the present invention, the spring 60 is initially compressed so it biases the mounting plate 12 against the backboard 14 with sufficient force that the mounting plate 12 remains substantially rigidly secured to the backboard 14 during conditions of regular use. Therefore, to compress the spring 60 further, thereby breaking away the goal 10 from the backboard 60, the compression force applied to the spring 60 must exceed the biasing force exerted by the spring 60 against the mounting plate 12. Thus, the threshold force—the force which, when applied to goal 10, results in breaking away of the goal 10 from the backboard 14 to be imminent—is adjusted by adjusting the amount the spring 60 is compressed when the mounting apparatus of the present invention is assembled.

It will be appreciated that the spring 60 must be stiff enough so that when the spring 60 is slightly compressed at the time the mounting apparatus is assembled, a sufficient biasing force will be applied to the mounting plate 12 to keep it biased against the backboard 14 during regular use. Additionally, if the spring constant of the spring 60 is too low, when a substantial force is imparted to the goal 10, causing the goal 10 to break away from the backboard by further compressing the spring 60, the spring 60 will quickly become fully compressed. If the spring 60 becomes fully compressed, then the energy transferred to the goal from the impact of a force applied to the goal 10 is not dissipated by the spring 60 and the advantages of the present invention are not realized. Alternatively, if the spring constant of the spring 60 is too high, the energy transferred to the goal from the impact of a substantial force applied to the goal 10 would not be dissipated by the spring 60 because the spring 60 would be so stiff it would be substantially rigid, and the impact of the force applied to the goal 10 may damage the goal 10 and/or backboard 14.

In operation, when someone dunks the basketball and suspends from the rim 15, a substantial force may be applied to the goal 10. If that force is greater than a threshold force, then the resulting forces acting on the mounting plate 12 of the goal 10 will cause the mounting plate 12 to pivot about a movable point at the lower portion of the mounting plate 12 near the holes 24 in the mounting plate 12.

When someone dunks the basketball, the force applied to the goal will vary each time. Thus, forces are applied to the goal in both vertical and horizontal directions. When the goal deflects away from the backboard, the pivot point at the lower portion of the mounting plate 12 varies according to the direction of the application of the force. When the force applied to the goal exceeds the threshold force, the upper portion of the mounting plate 12 near the holes 54 will deflect away from the backboard 14 along a substantially arcuate path about the pivot point as described above. As the upper portion of the mounting plate 12 deflects away from the backboard 14, the springs 60 on the biased mounting means 18 will compress thereby allowing the upper portion of the mounting plate 12 to deflect away from the backboard 14. As the springs 60 are compressed, the act of compressing the springs 60 absorbs much of the energy applied to the goal from the impact of the exerted force. As the upper portion of the mounting plate 12 separates from the backboard 14 by compressing the springs 60, the lower portion of the mounting plate 12 pivots about a movable point near the holes 24 by compressing the rings 30. The rings 30 provide sufficient flexibility to allow the lower portion of the mounting plate 12 to pivot, thereby allowing the goal 10 to break away from the backboard 14.

When the goal 10 breaks away from the backboard 14, the upper portion of the mounting plate 12 separates from the backboard 14 thereby creating a danger that someone using the goal could get a finger or piece of clothing caught in that opening. To eliminate this risk of harm to those using the goal, extending panels 68 on the shroud 26 are provided to cover the opening as can be seen in FIG. 1. The extending panels 68 cover both sides and the top of the opening created when the goal 10 is broken away from the backboard 14.

Figure 3:
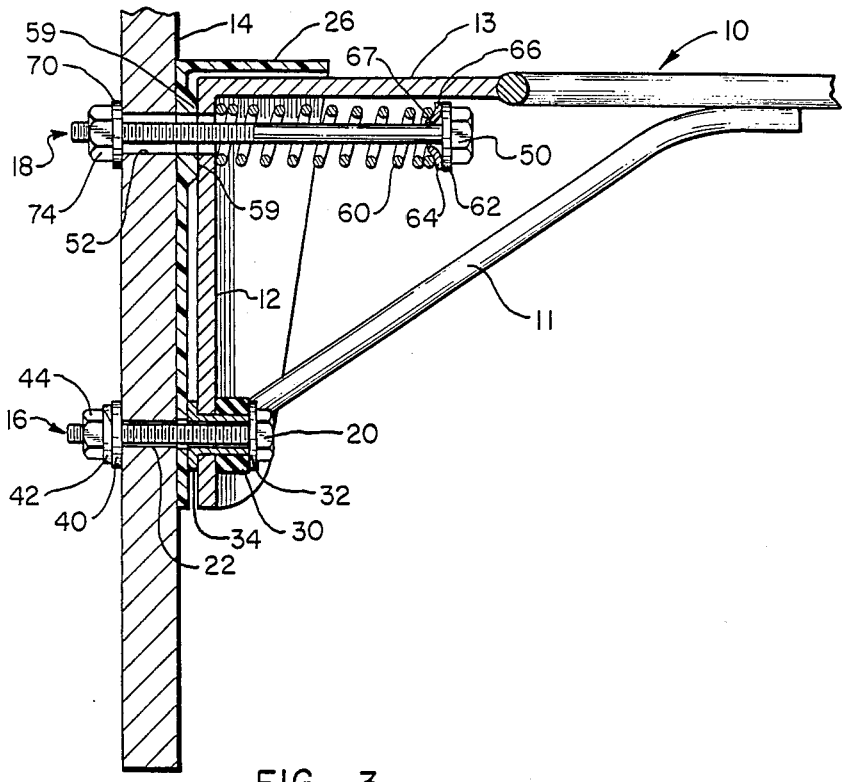
FIG. 3 is a cross-sectional view taken along line 3—3 of FIG. 2.
Figure 5:
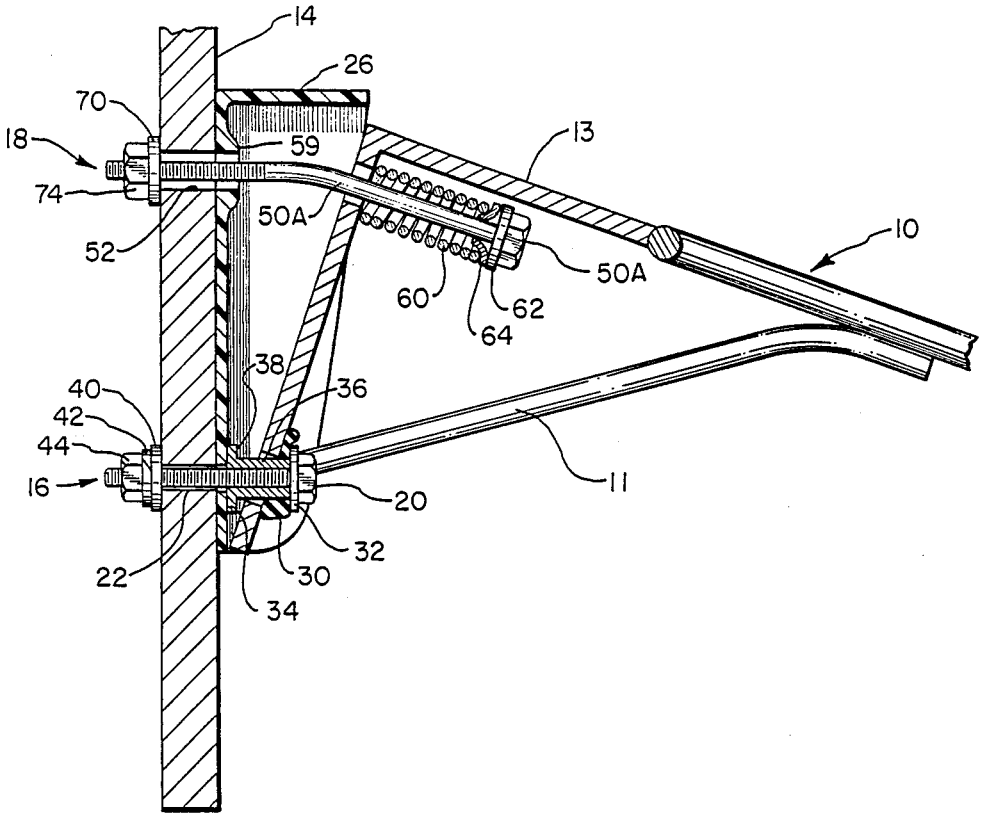
FIG. 5 is also a cross-sectional view similar to that illustrated in FIG. 3 but showing an alternate embodiment of the present invention in the broken-away position.

As can be seen in FIG. 4, when the basketball goal 10 is in the broken-away position, the plate 13 may interfere with the upper bolts 50 if the upper bolts 50 remained in a horizontal position. This problem can be solved according to the present invention by either of two methods. The upper mounting hole 52 in the backboard 14 may be elongated in a vertical direction as illustrated in FIGS. 3 and 4 or oversized so that as the goal 10 is broken away from the backboard 14, the upper bolts 50 may tilt slightly in a clockwise direction as viewed in FIG. 4, thereby eliminating the possibility of interference with the plate 13 of the basketball goal 10. Alternatively, an upper bolt 50A, as shown in FIG. 5, which is bent along a curved path may be employed. The bolt 50A may be pre-bent to conform to the required shape and then assembled, taking necessary precautions to ensure that when assembled the bolt is oriented in the proper direction. Alternatively, an unbent bolt may be used when assembling the apparatus and then the bolt may be manually bent along the desired curved path simply by applying a greater than threshold force to the basketball goal 10 and forcing the plate 13 down until it meets the upper portion of the conical washer 66 with sufficient force that the bolt 50 is bent into a curved shape as shown by bolt 50A in FIG. 5. It will be appreciated that this method for bending the bolt is somewhat crude and therefore it is preferred that interference with bolt 50 be avoided by reaming out in a vertical direction the upper mounting holes 52 in the backboard 14. Because some backboards may be made of metal or be provided with a metal sleeve surrounding the mounting holes 52, it may be impossible or undesirable to ream out the holes. If such is the case, then interference with plate 13 should be avoided by employing an upper bolt 50 which has been bent to a shape as shown by upper bolt 50A.

When the goal 10 is broken away from the backboard 14 as shown in FIG. 4, a substantial gap between the upper portion of mounting plate 12 and the backboard 14 may result. Since it is obviously very undesirable that someone using the goal 10 should get a finger or a piece of clothing caught in that gap when the goal 10 is released, the safety shroud 26 is provided to ensure that no foreign objects can lodge behind the upper portion of the mounting plate 12 when the goal 10 is broken away from the backboard 14. The shroud 26 is held against the backboard 14 by the flange 38 of T-nut 34 which is threaded on the lower bolt 20. Thus, the flange 38 of T-nut 34 prevents the shroud 26 from following the upper portion of mounting plate 12 when the goal 10 is broken away from the backboard 14.

The present invention may be embodied in other specific forms without departing from its spirit or essential characteristics. The described embodiment is thus to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed and desired to be secured by United States Letters Patent is:

1. An apparatus for flexibly mounting a basketball goal to a rigid support member whereby the goal retractably breaks away from the rigid support member when a force exceeding a threshold force is applied to the goal, the basketball goal having a rim and a mounting plate having an upper and a lower portion disposed perpendicular to the plane of the rim, comprising:

at least one flexible mounting means disposed near the lower portion of the mounting plate and securing the lower portion of the mounting plate in flexible connection to the rigid support member, said flexible mounting means being configured to permit pivoting of the goal away from the rigid support member about a point near the lower portion of the mounting plate when a force exceeding the threshold force is applied to the goal;

at least one biased mounting means disposed near the upper portion of the mounting plate and securing the upper portion of the mounting plate in biased abutment to the rigid support member, said biased mounting means being configured to permit the upper portion of the mounting plate to separate from the rigid support member along a substantially arc-shaped path as the goal pivots about the point near the lower portion of the mounting plate when a force exceeding the threshold force is applied to the goal;

a shroud connected between the mounting plate and the rigid support member, the shroud having extending panels which cover the space between the mounting plate and the rigid support member when the goal breaks away from the rigid support such that the shroud functions as a safety device; and a T-nut assembly having a T-nut which secures said shroud between the rigid support member and the T-nut.

2. An apparatus for flexibly mounting a basketball goal to a rigid support member as defined in claim 1, wherein said flexible mounting means comprises a connector and a resilient member wherein said connector holds said resilient member in abutment with the mounting plate.

3. An apparatus for flexibly mounting a basketball goal to a rigid support member as defined in claim 2, wherein said connector comprises a first bolt and nut assembly having a bolt and a nut and said resilient member comprises a ring disposed about the shaft of the bolt and secured in abutment with the mounting plate by the nut of said first bolt and nut assembly.

4. An apparatus for flexibly mounting a basketball goal to a rigid support member as defined in claim 1, wherein said biased mounting means comprises a second bolt and nut assembly and a biasing member, said second bolt and nut assembly having an upper bolt and a nut which secures said biasing member in abutment with the mounting plate.

5. An apparatus for flexibly mounting a basketball goal to a rigid support member as defined in claim 4, wherein said biasing member comprises a spring disposed about the shaft of the upper bolt and secured in abutment with the upper portion of the mounting plate by the nut of said second bolt and nut assembly.

6. An apparatus for flexibly mounting a basketball goal to a rigid support member as defined in claim 5, wherein said second bolt and nut assembly further comprises centering means for maintaining said spring in a concentric position surrounding the longitudinal axis of the upper bolt.

7. An apparatus for flexibly mounting a basketball goal to a rigid support member as defined in claim 6, wherein said centering means for maintaining the spring in a concentric position with the upper bolt comprises a conical washer.

8. An apparatus for flexibly mounting a basketball goal to a rigid support member as defined in claim 1, wherein said shroud has a spacer to facilitate the substantially vertical disposition of the mounting plate when said shroud is secured between the mounting plate and the rigid support member.

9. An apparatus for flexibly mounting a basketball goal to a rigid support member as defined in claim 1, wherein said flexible mounting means comprises a resilient unit being capable of compression when a force exceeding the threshold force is applied to the goal and such compression enables the point about which the goal pivots to move in response to the force applied to the goal.

10. An apparatus for flexibly mounting a basketball goal to a rigid support member whereby the goal retractably breaks away from the rigid support member when a force exceeding a threshold force is applied to the goal, the basketball goal having a rim and a mounting plate having an upper portion and a lower portion disposed perpendicular to the plane of the rim, comprising:

at least one flexibly mounting means disposed near the lower portion of the mounting plate and securing the lower portion of the mounting plate in flexible connection to the rigid support member, said flexible mounting means comprising a connector and a resilient member disposed between the mounting plate and the rigid support wherein said connector holds said resilient member in a normally partially compressed configuration and in abutment with the mounting plate, said flexible mounting means being configured to permit pivoting of the goal away from the rigid support member about a point near the lower portion of the mounting plate when a force exceeding the threshold force is applied to the goal, said resilient member being capable of further compression enabling the point about which the goal pivots to move in response to the force applied to the goal;

at least one biased mounting means disposed near the upper portion of the mounting plate and securing the upper portion of the mounting plate in biased abutment to the rigid support member, said biased mounting means being configured to permit the upper portion of the mounting plate to separate from the rigid support member along an arc-shaped path as the goal pivots about the point near the lower portion of the mounting plate when a force exceeding the threshold force is applied to the goal;

a shroud connected between the mounting plate and the rigid support member, said shroud having extended panels which cover the space between the mounting plate and the rigid support member when the goal breaks away from the rigid support member; and a T-nut assembly having a T-nut which secures said shroud between the rigid support member and said T-nut.

11. An apparatus for flexibly mounting a basketball goal to a rigid support member as defined in claim 10, wherein said connector comprises a first bolt and nut assembly having a bolt and a nut and said resilient member comprises a ring disposed about the shaft of the bolt and secured in abutment with the mounting plate by the nut of said first bolt and nut assembly.

12. An apparatus for flexibly mounting a basketball goal to a rigid support member as defined in claim 10, wherein said shroud has a spacer to facilitate the substantially vertical disposition of the mounting plate when said shroud is secured between the mounting plate and the rigid support member.

13. An apparatus for flexibly mounting a basketball goal to a rigid support member as defined in claim 10, wherein said biased mounting means comprises a biasing member and a second bolt and nut assembly having an upper bolt and a nut, wherein said second bolt and nut assembly holds said biasing member in abutment with the mounting plate.

14. An apparatus for flexibly mounting a basketball goal to a rigid support member as defined in claim 13, wherein said biasing member comprises a spring disposed about the shaft of the upper bolt and secured in abutment with the upper portion of the mounting plate by the nut of said second bolt and nut assembly

15. An apparatus for flexibly mounting a basketball goal to a rigid support member as defined in claim 14, wherein said second bolt and nut assembly further comprises centering means for maintaining said spring in a concentric position surrounding the longitudinal axis of the upper bolt.

16. An apparatus for flexibly mounting a basketball goal to a rigid support member as defined in claim 15, wherein said centering means for maintaining the spring in a concentric position with the upper bolt comprises a conical washer.

17. An apparatus for flexibly retrofitting a basketball goal to a rigid support member whereby the goal retractably breaks away from the rigid support member when a force exceeding a threshold force is applied to the goal, the basketball goal having a rim and a mounting plate having an upper portion and a lower portion disposed perpendicular to the plane to the rim, comprising:

at least one flexibly mounting means disposed near the lower portion of the mounting plate and securing the lower portion of the mounting plate in flexible connection to the rigid support member, said flexible mounting means comprising a connector and a resilient member disposed between the mounting plate and the rigid support wherein said connector holds said resilient member in and normally partially compressed configuration and in abutment with the mounting plate, said flexible mounting means being configured to permit pivoting of the goal away from the rigid support member about a point near the lower portion of the mounting plate when a force exceeding the threshold force is applied to the goal, said resilient member being capable of further compression enabling the point about which the goal pivots to move in response to the force applied to the goal;

at least one biased mounting means disposed near the upper portion of the mounting plate and securing the upper portion of the mounting plate in biased abutment to the rigid support member, said biased mounting means being configured to permit the upper portion of the mounting plate to separate from the rigid support member along an arc-shaped path as the goal pivots about the point near the lower portion of the mounting plate when a force exceeding the threshold force is applied to the goal;

a shroud connected between the mounting plate and the rigid support member, said shroud having extending panels which cover the space between the mounting plate and the rigid support member when the goal breaks away from the rigid support member; and a T-nut assembly having a T-nut which secures said shroud between the rigid support member and said T-nut.

18. An apparatus for flexibly retrofitting a basketball goal to a rigid support member as defined in claim 17, wherein said adjustable biased mounting means comprises a biasing member and a second bolt and nut assembly having an upper bolt and a nut.

19. An apparatus for flexibly retrofitting a basketball goal to a rigid support member as defined in claim 18, wherein said biasing member comprises a spring disposed about the shaft of the upper bolt and secured in abutment with the upper portion of the mounting plate by the nut of said second bolt and nut assembly.

20. An apparatus for flexibly retrofitting a basketball goal to a rigid support member as defined in claim 19, wherein said second bolt and nut assembly further comprises centering means for maintaining said spring in a concentric position surrounding the longitudinal axis of the upper bolt.

21. An apparatus for flexibly retrofitting a basketball goal to a rigid support member as defined in claim 20, wherein said centering means for maintaining the spring in a concentric position with the upper bolt comprises a conical washer.

22. An apparatus for flexibly retrofitting a basketball goal to a rigid support member as defined in claim 18, wherein the tension in said spring is adjustable by tightening or loosening the nut thereby raising or lowering the threshold force necessary to cause the goal to break away from the rigid support member.

23. An apparatus for flexibly retrofitting a basketball goal to a rigid support member as defined in claim 17, wherein said flexible mounting means comprises a connector and a resilient member wherein said connector holds said resilient member in abutment with the mounting plate.

24. An apparatus for flexibly retrofitting a basketball goal to a rigid support member as defined in claim 23, wherein said connector comprises a first bolt and nut assembly having a bolt and a nut and said resilient member comprises a ring disposed about the shaft of the bolt and secured in abutment with the mounting plate by the nut of said first bolt and nut assembly.

25. An apparatus for flexibly retrofitting a basketball goal to a rigid support member as defined in claim 25, wherein said shroud has a spacer to facilitate the substantially vertical disposition of the mounting plate when said shroud is secured between the mounting plate and the rigid support member.

26. An apparatus for flexibly retrofitting a basketball goal to a rigid support member as defined in claim 17, wherein said flexible mounting means comprises a resilient unit being capable of compression when a force exceeding the threshold force is applied to the goal and such compression enables the point about which the goal pivots to move in response to the force applied to the goal.

* * * * *